US007705786B2

(12) United States Patent
Iellici et al.

(10) Patent No.: US 7,705,786 B2
(45) Date of Patent: Apr. 27, 2010

(54) ANTENNA FOR MOBILE TELEPHONE HANDSETS, PDAS, AND THE LIKE

(75) Inventors: Devis Iellici, Cambridge (GB); Simon Philip Kingsley, Cambridge (GB); James William Kingsley, Cambridge (GB); Steven Gregory O'Keefe, Queensland (AU)

(73) Assignee: Antenova Ltd., Cambridge (GB)

( * ) Notice: Subject to any disclaimer, the term of this patent is extended or adjusted under 35 U.S.C. 154(b) by 554 days.

(21) Appl. No.: 10/582,641

(22) PCT Filed: Dec. 10, 2004

(86) PCT No.: PCT/GB2004/005158

§ 371 (c)(1),
(2), (4) Date: Jun. 12, 2006

(87) PCT Pub. No.: WO2005/057722

PCT Pub. Date: Jun. 23, 2005

(65) Prior Publication Data

US 2007/0120740 A1 May 31, 2007

(30) Foreign Application Priority Data

Dec. 12, 2003 (GB) ..... 0328811.5

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS 5,010,349 A * 4/1991 Mizuno et al. ..... 343/700 MS
5,434,579 A 7/1995 Kagoshima et al.
5,684,492 A 11/1997 Kagoshima et al.

(Continued)

FOREIGN PATENT DOCUMENTS

EP 1 018 779 7/2000

(Continued)

OTHER PUBLICATIONS

Kingsley, S.P. et al.:"Advancements in Antennas: The development of dielectric antennas technology", Antenna Systems, Oct. 8, 2003, 6 pages.

(Continued)

*Primary Examiner*—Trinh V Dinh
*Assistant Examiner*—Dieu Hien T Duong
(74) *Attorney, Agent, or Firm*—Pearl Cohen Zedek Latzer, LLP

(57) ABSTRACT

The present invention relates to an antenna structure comprising a dielectric pellet and a dielectric substrate with upper and lower surfaces and at least one groundplane, wherein the dielectric pellet is elevated above the upper surface of the dielectric substrate such that the dielectric pellet does not directly contact the dielectric substrate or the groundplane, and wherein the dielectric pellet is provided with a conductive direct feed structure. A radiating antenna component is additionally provided and arranged so as to be excited by the dielectric pellet. Elevating the dielectric antenna component so that it does not directly contact the groundplane or the dielectric substrate significantly improves bandwidth of the antenna as a whole.

27 Claims, 11 Drawing Sheets

U.S. PATENT DOCUMENTS

| | | | | |
|---|---|---|---|---|
| 5,801,660 | A * | 9/1998 | Ohtsuka et al. | 343/700 MS |
| 5,940,036 | A | 8/1999 | Oliver et al. | |
| 5,952,972 | A | 9/1999 | Ittipiboon et al. | |
| 5,959,582 | A * | 9/1999 | Kawahata et al. | 343/700 MS |
| 6,147,650 | A * | 11/2000 | Kawahata et al. | 343/702 |
| 6,236,368 | B1 | 5/2001 | Johson | |
| 6,384,793 | B2 * | 5/2002 | Scordilis | 343/767 |
| 6,680,705 | B2 * | 1/2004 | Tan et al. | 343/702 |
| 6,795,023 | B2 * | 9/2004 | Chen | 343/700 MS |
| 7,102,573 | B2 * | 9/2006 | Morrow et al. | 343/700 MS |
| 2002/0084937 | A1 | 7/2002 | Sinichi | |
| 2003/0043075 | A1 | 3/2003 | Bit-Babik et al. | |
| 2003/0132885 | A1 * | 7/2003 | Kuramoto et al. | 343/702 |
| 2003/0146878 | A1 * | 8/2003 | Mikkola et al. | 343/702 |
| 2003/0189525 | A1 | 10/2003 | Tan et al. | |

FOREIGN PATENT DOCUMENTS

| | | |
|---|---|---|
| EP | 1 351 334 | 10/2003 |
| GB | 2 386 758 | 9/2003 |
| GB | 2 388 964 | 11/2003 |
| GB | 2 403 069 | 12/2004 |
| WO | WO 01/57952 | 8/2001 |

OTHER PUBLICATIONS

Long, R.T et al.: "Use of parasitic strip to produce circular polarization and increased bandwidth for cylindrical dielectric resonator antenna", Electronic Letters, IEEE Stevenage, GB, vol. 37, No. 7 12 pages.

Long, S.A., McAllister, M.W., and Shen, L.C.: "The Resonant Cylindrical Dielectric Cavity Antenna", IEEE Transactions on Antennas and Propagation, AP-31, 1983, pp. 406-412.

Mongia, R.K. and Bhartia, P.: "Dielectric Resonator Antennas- A Review and General Design Relations for Resonant Frequency and Bandwidth", International Journal of Microwave and Millimitre-Wave Computer-Aided Engineering. 1994, 4, (3), pp. 230-247.

Mongia R.K. et al: "Theoretical and Experimental Investigations on Rectangular Dielectric Resonator Antennas", IEEE Transactions on Antennas and Propagation, IEEE Inc. New York, US, vol. 45, No. 9 pp. 1348-1356.

Petosa, A., Ittiboon, A., Antar, Y.M.M., Roscoe, D. and Cuhaci, M.: "Recent advances in Dielectric-Resonator Antenna Technology", IEEE Antennas and Propagation Magazine, 1998, 40, (3), pp. 35-48.

Shum, L.K. and K.M. Luk: "Stacked annular ring dielectric resonator antenna excited by axi-symmetric coaxial probe", IEEE Transactions on Antennas and Propagation, vol. 43, No. 8 pp. 889-892.

International Search Report for Application No. PCT/GB2004/005158, (4 pages).

Combined Search and Examination Report for Application No. GB0427117.7 dated Apr. 8, 2005, (1 page).

* cited by examiner

| 1: Mkr (MHz) | dB | 2: Mkr (MHz) dB |
|---|---|---|
| 1> 824.0000 | -9.008 | |
| 2: 960.0000 | -7.962 | |
| 3: 1710.0000 | -4.166 | |
| 4: 1990.0000 | -5.556 | |

ANTENNA FOR MOBILE TELEPHONE HANDSETS, PDAS, AND THE LIKE

PRIOR APPLICATION DATA

The present application is a national phase application of International Application PCT/GB2004/005158, entitled "ANTENNA FOR MOBILE TELEPHONE HANDSETS, PDAs AND THE LIKE" filed on Dec. 10, 2004, which in turn claims priority from British application GB0328811.5, filed on Dec. 12, 2003, all of which are incorporated by reference in their entirety.

FIELD OF THE INVENTION

The present invention relates to antenna structures, including multi-band antenna structures, and techniques for the construction thereof, where an antenna is required to be mounted on a printed wiring board (PWB) or printed circuit board (PCB) that has a full ground plane (i.e. metallised layer) on a side opposed to that on which the antenna is mounted. Embodiments of the present invention also provide advantages in applications without a significant ground plane.

BACKGROUND OF THE INVENTION

The present invention relates to antenna structures, including multi-band antenna structures, and techniques for the construction thereof, where an antenna is required to be mounted on a printed wiring board (PWB) or printed circuit board (PCB) that has a full ground plane (i.e. metallised layer) on a side opposed to that on which the antenna is mounted. Embodiments of the present invention also provide advantages in applications without a significant ground plane.

It is often advantageous in the design of an electrically small antenna to remove part of the ground plane on both sides of a PCB or through all the layers of a PWB as this can help to improve the bandwidth of the antenna. Unfortunately, many modern mobile telephone handsets have so many components to be fitted on the reverse side from the antenna (speakers, headphone sockets, USB connectors, display technology, etc.) that it is preferable not to remove the ground plane, either fully or partially. It is therefore desirable to find a way of designing an antenna for mounting on a PCB/PWB, the antenna having the wide bandwidth required for modern mobile telephone handsets while still retaining a full ground plane beneath the antenna.

Dielectric antennas are antenna devices that radiate or receive radio waves at a chosen frequency of transmission and reception, as used in for example in mobile telecommunications.

The present applicant has conducted wide-ranging research in the field of dielectric antennas, and the following nomenclature will be used in the application:

High Dielectric Antenna (HDA): Any antenna making use of dielectric components either as resonators or in order to modify the response of a conductive radiator.

The class of HDAs is then subdivided into the following:

a) Dielectrically Loaded Antenna (DLA): An antenna in which a traditional, electrically conductive radiating element is encased in or located adjacent to a dielectric material (generally a solid dielectric material) that modifies the resonance characteristics of the conductive radiating element. Generally speaking, encasing a conductive radiating element in a solid dielectric material allows the use of a shorter or smaller radiating element for any given set of operating characteristics. In a DLA, there is only a trivial displacement current generated in the dielectric material, and it is the conductive element that acts as the radiator, not the dielectric material. DLAs generally have a well-defined and narrowband frequency response.

b) Dielectric Resonator Antenna (DRA): An antenna in which a dielectric material (generally a solid, but could be a liquid or in some cases a gas) is provided on top of a conductive groundplane, and to which energy is fed by way of a probe feed, an aperture feed or a direct feed (e.g. a microstrip feedline). Since the first systematic study of DRAs in 1983 [LONG, S. A., McALLISTER, M. W., and SHEN, L. C.: "The Resonant Cylindrical Dielectric Cavity Antenna", IEEE Transactions on Antennas and Propagation, AP-31, 1983, pp 406-412], interest has grown in their radiation patterns because of their high radiation efficiency, good match to most commonly used transmission lines and small physical size [MONGIA, R. K. and BHARTIA, P.: "Dielectric Resonator Antennas—A Review and General Design Relations for Resonant Frequency and Bandwidth", International Journal of Microwave and Millimeter-Wave Computer-Aided Engineering, 1994, 4, (3), pp 230-247]. A summary of some more recent developments can be found in PETOSA, A., ITTIPIBOON, A., ANTAR, Y. M. M., ROSCOE, D., and CUHACI, M.: "Recent advances in Dielectric-Resonator Antenna Technology", IEEE Antennas and Propagation Magazine, 1998, 40, (3), pp 35-48. DRAs are characterised by a deep, well-defined resonant frequency, although they tend to have broader bandwidth than DLAs. It is possible to broaden the frequency response somewhat by providing an air gap between the dielectric resonator material and the conductive groundplane. In a DRA, it is the dielectric material that acts as the primary radiator, this being due to non-trivial displacement currents generated in the dielectric by the feed.

c) Broadband Dielectric Antenna (BDA): Similar to a DRA, but with little or no conductive groundplane. BDAs have a less well-defined frequency response than DRAs, and are therefore excellent for broadband applications since they operate over a wider range of frequencies. Again, in a BDA, it is the dielectric material that acts as the primary radiator, not the feed. Generally speaking, the dielectric material in a BDA can take a wide range of shapes, these not being as restricted as for a DRA. Indeed, any arbitrary dielectric shape can be made to radiate in a BDA, and this can be useful when trying to design the antenna to be conformal to its casing.

d) Dielectrically Excited Antenna (DEA): A new type of antenna developed by the present applicant in which a DRA, BDA or DLA is used to excite an electrically conductive radiator. DEAs are well suited to multi-band operation, since the DRA, BDA or DLA can act as an antenna in one band and the conductive radiator can operate in a different band. DEAs are similar to DLAs in that the primary radiator is a conductive component (such as a copper dipole or patch), but unlike DLAs they have no directly connected feed mechanism. DEAs are parasitic conducting antennas that are excited by a nearby DRA, BDA or DLA having its own feed mechanism. There are advantages to this arrangement, as outlined in UK patent application no 0313890.6 of 16th Jun. 2003.

The dielectric material of a dielectric antenna can be made from several candidate materials including ceramic dielectrics, in particular low-loss ceramic dielectric materials.

For the avoidance of doubt, the expression "electrically-conductive antenna component" defines a traditional antenna component such as a patch antenna, slot antenna, monopole antenna, dipole antenna, planar inverted-L antenna (PILA), planar inverted-F antenna (PIFA) or any other antenna component that is not an HDA.

It is known from U.S. Pat. No. 5,952,972 to provide a rectangular dielectric resonator antenna having a notch at a centre of its underside. The authors clearly believe the slot is the cause of the enhanced bandwidth together with a slab of high dielectric material inserted into the slot. However, this device might be viewed in a different way as a rectangular dielectric pellet elevated by 'legs' at each end. It is important to appreciate that the pellet rests on a groundplane which is on the top surface of a PCB, and that the pellet is fed by a slot in the groundplane surface. There is no feed taken up to the pellet and the pellet is not described as being metallised on any of its surfaces. The antenna of U.S. Pat. No. 5,952,972 is therefore:

1. A DRA and not a BDA.
2. Not an elevated pellet clear of the groundplane.
3. Without an elevated feed.
4. Without a parasitic DEA component.
5. Not designed for inclusion in modern radiotelephone handsets.

It is also known from IEEE Transactions on Antennas and Propagation, Vol. 43, No. 8, August 1995, pp 889-892, "Stacked annular ring dielectric resonator antenna excited by axi-symmetric coaxial probe", Shum & Luk to provide a DRA comprising an annular ring dielectric element elevated above a groundplane and excited by a coaxial probe extending through a hole in the groundplane and into the central hole of the dielectric element. This arrangement is said to improve bandwidth. A further improvement to bandwidth is obtained by providing a second, parasitic annular ring dielectric element above the main one.

SUMMARY

According to an aspect of the present invention, there is provided an antenna structure comprising a dielectric pellet and a dielectric substrate with upper and lower surfaces and at least one groundplane, wherein the dielectric pellet is elevated above the upper surface of the dielectric substrate such that the dielectric pellet does not directly contact the dielectric substrate or the groundplane, the dielectric pellet being provided with an electrically-conductive direct feed structure, and wherein the antenna structure additionally comprises a radiating antenna component which is elevated above the upper surface of the dielectric substrate and has a surface that faces a surface of the dielectric pellet.

The expression dielectric pellet is intended to denote an element of dielectric material, preferably a dielectric ceramic material or other low-loss dielectric material, of appropriate shape.

The conductive direct feed structure advantageously extends from the upper surface of the dielectric substrate and directly contacts the dielectric pellet. In preferred embodiments, the feed structure serves physically to support or elevate the dielectric pellet above the upper surface of the dielectric substrate. However, in some embodiments the feed structure serves only to transfer energy to or from the dielectric pellet, the pellet being physically supported or elevated by some other means, for example by being suspended from or attached to an additional substrate disposed above the upper surface of the dielectric substrate.

The conductive direct feed structure may be a conducting leg, a spring-loaded pin (a "Pogopin"), a metal strip or ribbon (preferably with sufficient rigidity to support the dielectric pellet) or any other appropriate structure, and generally extends substantially perpendicularly from the upper surface of the dielectric substrate, although it may also be inclined relative thereto. It will be appreciated that it is difficult to use a conventional printed microstrip feed, coplanar feed or other type of printed transmission line to feed the dielectric pellet when elevated above the upper surface of the dielectric substrate.

The conductive feed structure may contact an underside of the dielectric pellet (i.e. the side or surface that generally faces the upper surface of the dielectric substrate), or may contact any of the other sides or surfaces of the dielectric pellet. Advantageously, the side or surface of the dielectric pellet that is contacted by the conductive feed structure may be metallised. One or more other sides or surfaces of the dielectric pellet may also be metallised.

Where the underside of the dielectric pellet is contacted by the conductive feed structure, it is particularly preferred that the conductive feed structure is in the form of a spring-loaded pin extending from the upper surface of the dielectric substrate.

The dielectric pellet may be contacted by the conductive feed structure on more than one side, for example on several sides together. In one embodiment, the dielectric pellet may be contained within an electrically conductive cup or cage (e.g. cup or cage 17 in FIG. 18), and the cup or cage may be then fed by the conductive feed structure.

An electrical connection between the conductive feed structure and the dielectric pellet may be made by soldering or by mechanical pressure.

The dielectric pellet may have any suitable shape. In some embodiments, the pellet is generally oblong or parallelepiped, optionally with one or more chamfered edges.

In embodiments where the antenna structure is intended to be enclosed within a mobile telephone or PDA (personal digital assistant) or laptop computer casing or the like, it may be advantageous for the dielectric pellet, in particular but not exclusively upper and/or side surfaces thereof, to be shaped so as to be generally conformal with the casing, thereby making best use of the small amount of space available within the casing. In these embodiments, the dielectric pellet may be physically supported from above by the casing or by any other low permittivity antenna support structure. By "low permittivity" is meant a permittivity or dielectric constant significantly less than that of the dielectric material from which the dielectric pellet is made, for example a permittivity not more than 10% of the permittivity of the dielectric pellet material itself.

It is to be appreciated that the antenna structure of embodiments of the present invention is not restricted to use with mobile telephone handsets and PDAs, but may find more general application. One particular area where these antenna structures may find utility is for use as wide bandwidth WLAN antennas where a full groundplane is needed, for example for use in laptop computers or access points.

The groundplane may be located on the upper or the lower surface or both surfaces of the dielectric substrate, or one or more groundplanes may be respectively sandwiched or embedded between two or more layers making up the dielectric substrate. In certain embodiments, the groundplane extends across at least that part of the dielectric substrate that is located below the dielectric pellet, and in some embodiments, extends across substantially the entire area of the dielectric substrate. In other embodiments, the groundplane may be absent from an area of the dielectric substrate that is located below the dielectric pellet. Removal of the groundplane in this way can provide even further expansion of the bandwidth of the antenna as a whole.

Because the dielectric pellet is elevated above the upper surface of the dielectric substrate and does not directly contact this surface, it will be understood that a gap is thus defined between the dielectric pellet and the upper surface of the dielectric substrate. In simple embodiments, this gap is an air gap. However, the gap may alternatively be filled with dielectric material or materials other than air, for example a spacer or the like made out of a dielectric material with a lower, preferably significantly lower dielectric constant than that of the material of the dielectric pellet. In some embodiments, the spacer or the like is made of a dielectric material with a dielectric constant of no more than 10% of that of the dielectric pellet itself. The presence of this air gap or dielectric spacer may help to improve the bandwidth of the antenna structure as a whole when the dielectric pellet is energised by the conductive feed or by incoming radio/microwave signals.

In some embodiments, the antenna structure may include more than one elevated dielectric pellet.

In other embodiments, a single elevated dielectric pellet may be used to feed or excite two or more radiating antenna components, for example two or more PILAs or DLAs or other antennas. One of the radiating antenna components (for example, a PIFA) may itself be driven by an independent feed, with the dielectric pellet serving to load the radiating antenna component in a desired manner. By feeding two or more radiating antenna components by a single elevated dielectric pellet, an extra resonance may be created, which may, for example, be used for GPS reception.

It is currently thought by the present applicant that the elevated dielectric pellet is not in itself a significant radiating component (such as a dielectric antenna), but instead serves primarily as a matching component for the radiating antenna component that is contacted thereby. In this way, careful selection and positioning of the dielectric pellet can ensure a good impedance match for any desired radiating antenna component.

The dielectric pellet and the conductive feed together allow the radiating antenna component to be fed without significant inductance, which is a serious problem with capacitive feeding. In some respects, the dielectric pellet can be considered to be acting as a "dielectric capacitor".

The radiating antenna component may be a patch antenna, slot antenna, monopole antenna, dipole antenna, planar inverted-L antenna, planar inverted-F antenna or any other type of electrically-conductive antenna component.

Alternatively, the radiating antenna component may be configured as a DLA, for example in the form of a PILA formed on or extending over a block or pellet of dielectric material.

The dielectric pellet may physically contact the radiating antenna component, or there may be a small air gap or other dielectric spacer material (e.g., material 18 in FIG. 20) between the dielectric pellet and the radiating antenna component.

The radiating antenna component may pass over or close to or contact the dielectric pellet just once, or may be configured so as to double back on itself so as to provide two (or more) locations where it is excited by the dielectric pellet. This configuration reduces the space required to contain a radiating antenna component of any given length.

In a further embodiment, a radiating antenna component may be provided as discussed above, but configured such that the radiating antenna component is provided with its own feed and is driven separately from the dielectric pellet.

One or other or both or the dielectric pellet and the radiating antenna component may have series and parallel tuning components. Where a PILA or PIFA is included, the PILA or PIFA may have tuned, switched or active short circuits.

With particular reference to the use of a PILA as the radiating antenna component, the leg of the PILA may be electrically connected to the ground plane and serve as a shorting pin. The present applicant has found that feeding the PILA with the dielectric pellet in different locations relative to the shorting pin or leg can provide feeding at different capacitances. Generally speaking, the greater the distance between the shorting pin or leg and the dielectric pellet, the lower the capacitance.

BRIEF DESCRIPTION OF THE DRAWINGS

For a better understanding of the present invention and to show how it may be carried into effect, reference shall now be made by way of example to the accompanying drawings, in which.

DETAILED DESCRIPTION OF THE INVENTION

Figure 1:
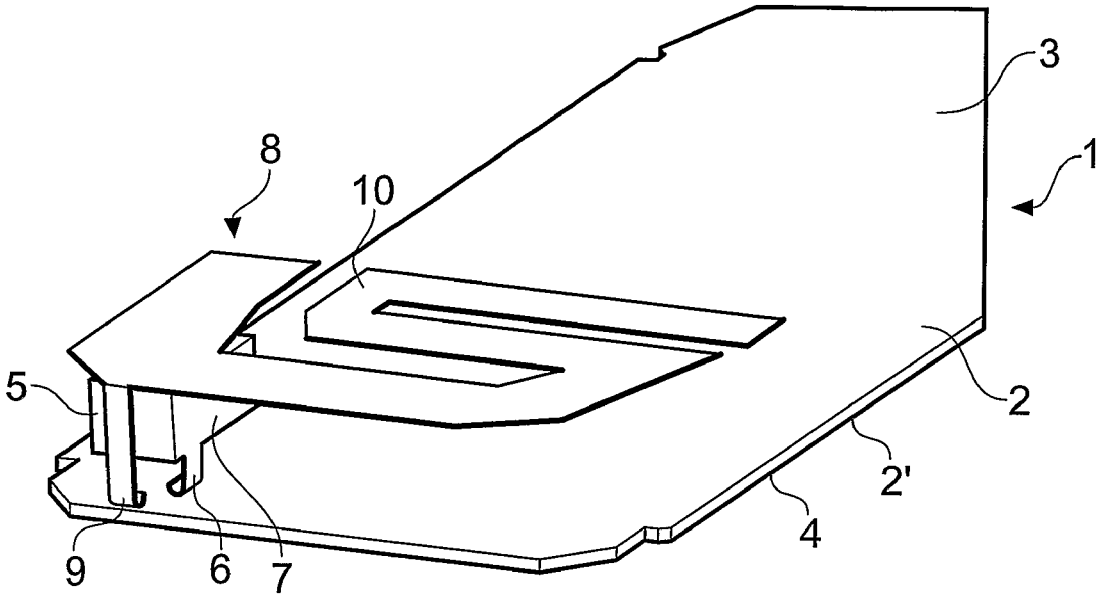
FIG. 1 shows a first embodiment of the present invention.
Figure 19:
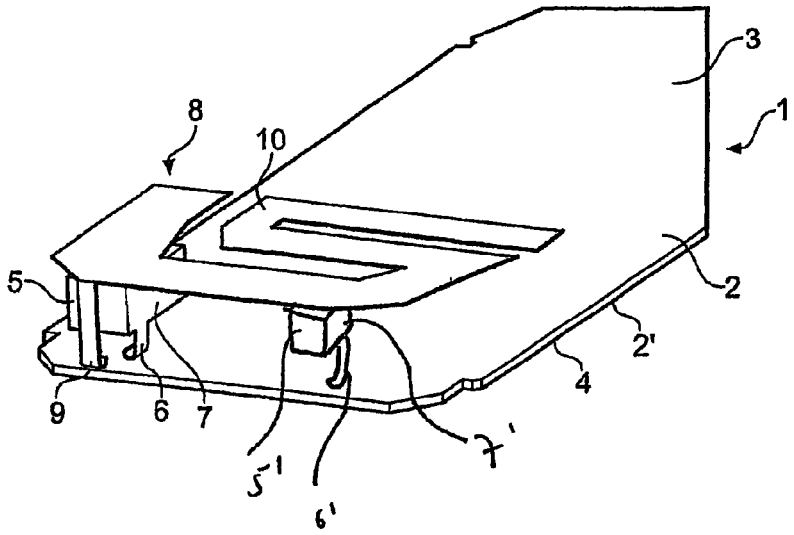
FIG. 19 shows a plurality of dielectric pellets.
Figure 20:
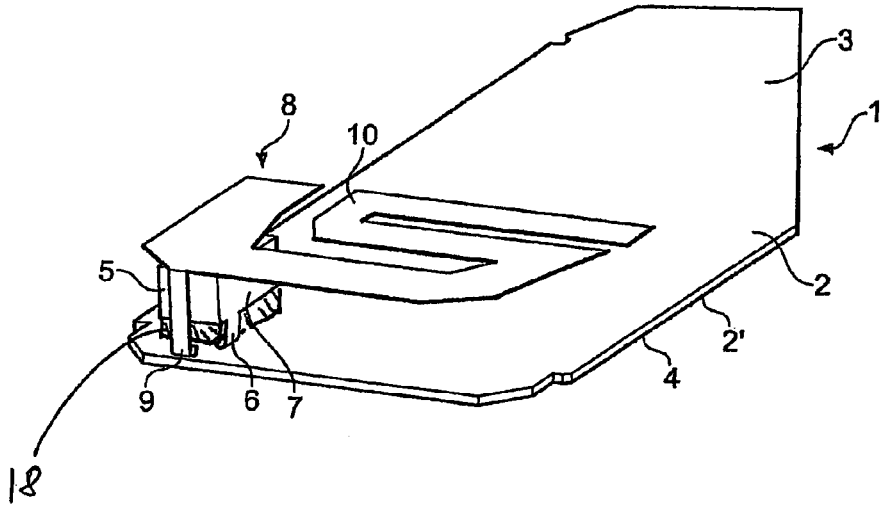
FIG. 20 shows a gap defined between the dielectric pellet and the upper surface of the dielectric substrate.
Figure 21:
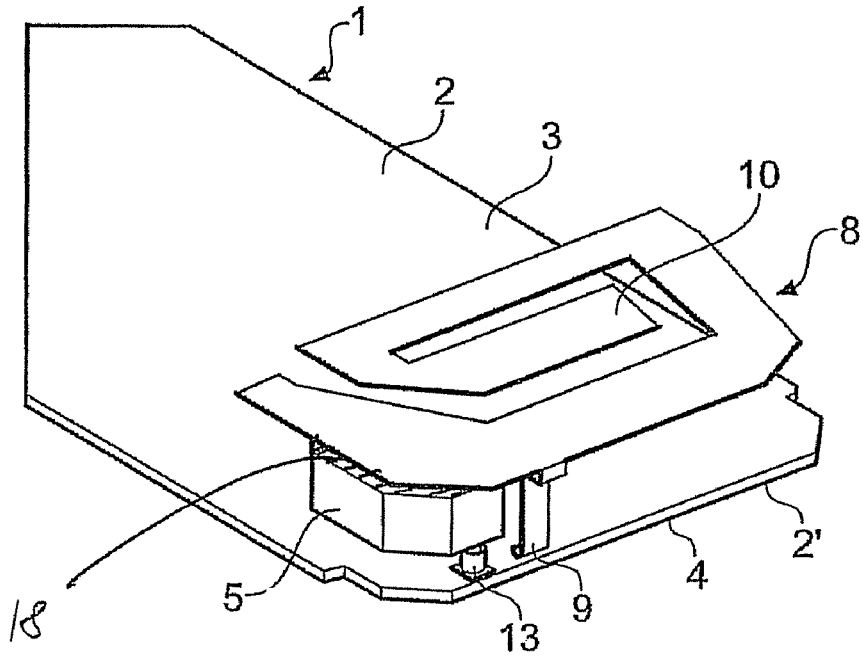
FIG. 21 shows a dielectric spacer material between the surface of the dielectric pellet and the radiating antenna component.

FIGS. 1 and 19 show a dielectric substrate in the form of a printed circuit board (PCB) 1 having upper 3 and lower 4 surfaces and a conductive groundplane 2, 2' on each of the upper 3 and lower 4 surfaces. The PCB 1 shown in the Figure is suitable for incorporation into a mobile telephone handset (not shown), and the lower surface 4 will generally serve as a support for the various electronic components (not shown) of the mobile telephone. A ceramic dielectric pellet 5 (and 5') is mounted on a conductive direct feed structure 6 (and 6') in the form of a metal ribbon extending upwardly from the upper surface 3 of the PCB 1 in a corner thereof. In this way, the pellet 5 is raised or elevated over the PCB 1 and the groundplane 2 and does not directly contact either of these. The provision of an air gap between the pellet 5 and the groundplane 2 serves to improve bandwidth. The feed 6 is attached by way of soldering to a metallised inner side wall 7 (and 7') of the pellet 5. The other end of the feed 6 is connected to a signal source (not shown).

In addition to the dielectric pellet 5 and the feed 6, there is provided a planar inverted-L antenna (PILA) 8 including a leg 9 and an 'S'-shaped radiating section 10. The leg 9 is mounted on the upper surface 3 of the PCB 1 and provides a short circuit to the groundplane 2. The radiating section 10 extends over a top surface of the pellet 5. During operation, the pellet 5 is excited by way of the feed 6. The PILA 8 is in turn driven by the pellet 5 and radiates over a broad frequency range, thus providing broadband operation. By adjusting the relative dispositions of the pellet 5 and the PILA 8, it is possible to adjust the radiating frequencies.

Figure 2:
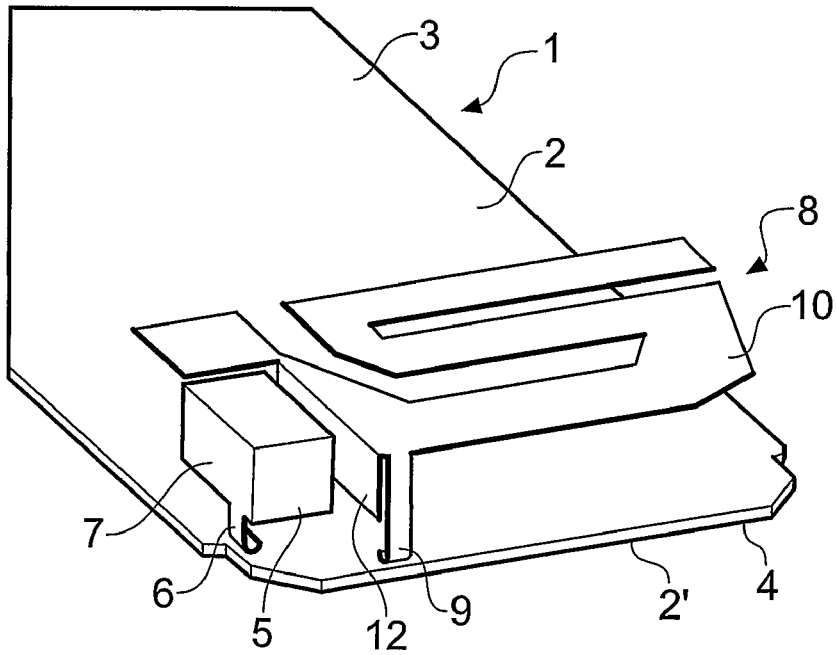
FIG. 2 shows a second embodiment of the present invention.

FIG. 2 shows an alternative embodiment in which the pellet 5 is mounted on a feed 6 in the form of a metallic ribbon, but this time attached to a metallised outer side wall 11 of the pellet 5. A PILA 8 with a short circuit leg 9 and radiating section 10 is also provided as in FIG. 1, but here the PILA 8 includes a vertical capacitive flap 12 which faces the inner side wall 7 of the pellet 5. Adjusting the size and/or disposition of the capacitive flap 12 allows the frequencies of operation to be adjusted. In comparison to the embodiment of FIG. 1, the capacitive flap 12 of the embodiment of FIG. 2 may allow a lower band frequency to be lowered to a somewhat greater degree.

Figure 3:
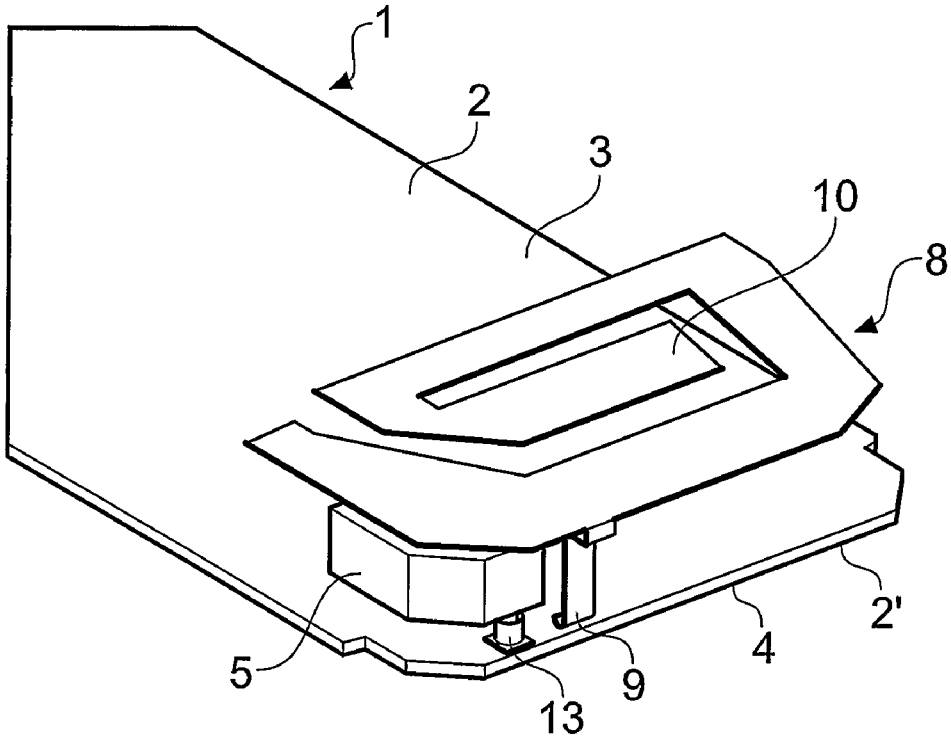
FIG. 3 shows a third embodiment of the present invention.

FIG. 3 shows an alternative embodiment in which the pellet 5 is mounted on a feed in the form of a spring-loaded pin ('Pogopin') 13 which extends from the upper surface 3 of the PCB 1 and contacts a metallised underside of the pellet 5. This arrangement can have advantages in that the pellet 5 can be easily mounted on the pin 13 by way of mechanical pressure. A PILA 8 with a leg 9 and a radiating section 10 is provided as before, the radiating section 10 having a spiral configuration and passing over the upper surface of the pellet 5.

Figure 4:
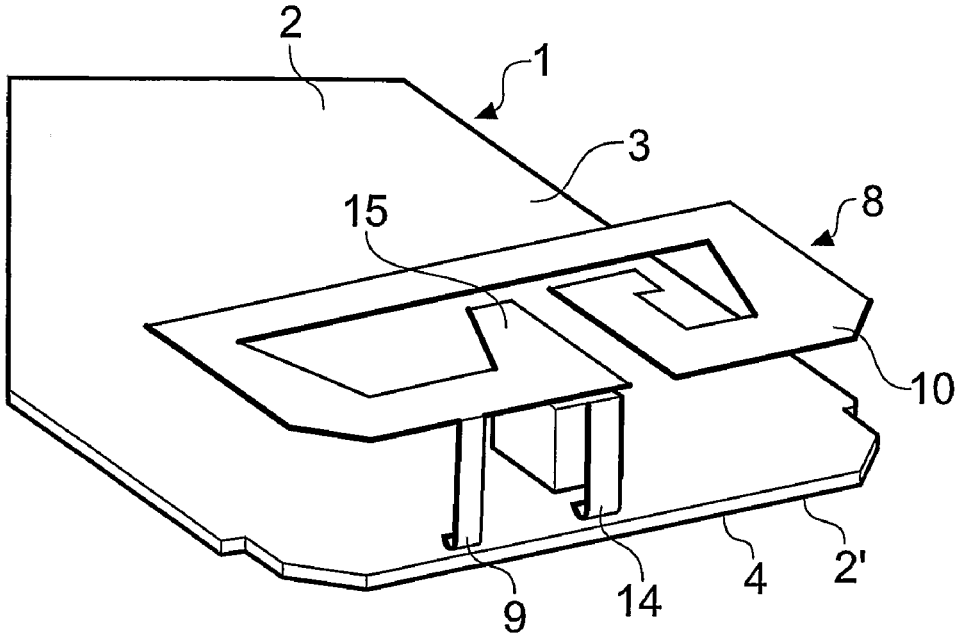
FIG. 4 shows a fourth embodiment of the present invention.

FIG. 4 shows an alternative embodiment in which the pellet 5 is mounted not in the corner of the PCB 1, but about halfway along an edge of the PCB 1. The pellet 5 is elevated over the groundplane 2 as before, but this time with a spring-loaded metal strip 14 which acts as the feed 6. The spring-loaded metal strip 14 contacts an upper, metallised surface 14 of the pellet 5. In this embodiment, the PILA 8 has a double spiral configuration, one arm 15 of the radiating section 10 passing over the top of the pellet.

Figure 5:
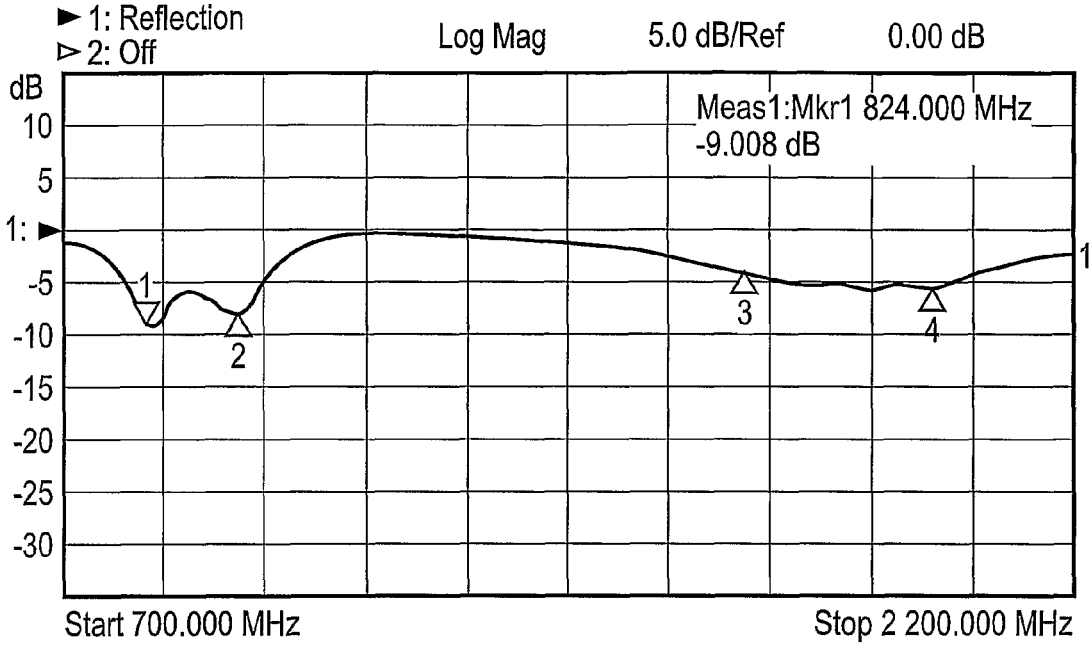
FIG. 5 shows a plot of return loss of a first antenna embodying the present invention.

FIG. 5 shows a typical return loss of an elevated-pellet handset antenna of the embodiment of the present invention shown in FIG. 1. It can be seen that the return loss pattern allows quadruple band operation at 824 MHz, 960 MHz, 1710 MHz and 1990 MHz. The extra bandwidth in the upper band is a result of the pellet 5 being elevated above the groundplane 2.

Figure 6:
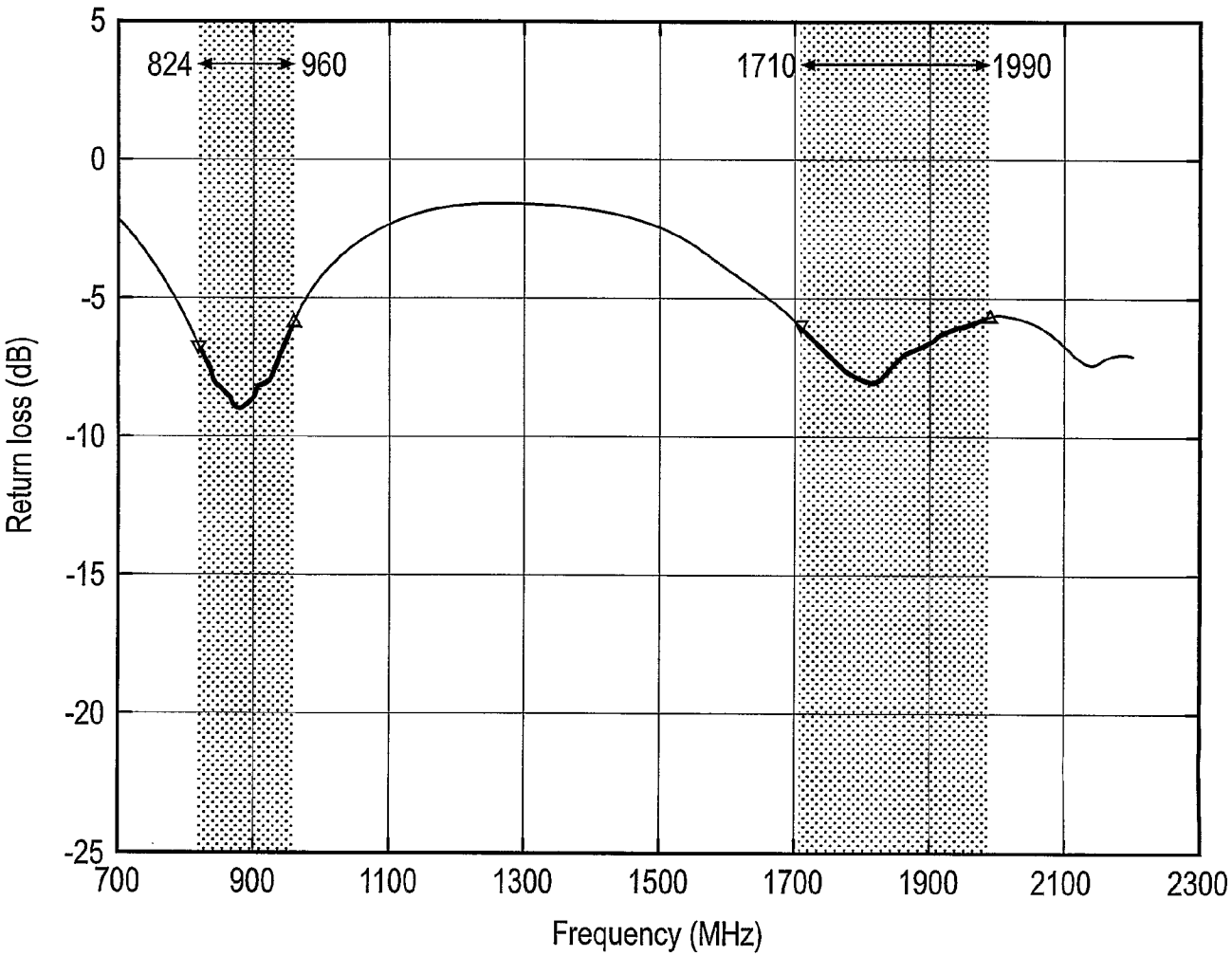
FIG. 6 shows a plot of return loss of a second antenna embodying the present invention.

FIG. 6 shows a typical return loss of an elevated-pellet handset antenna of the embodiment of the present invention shown in FIG. 3. It can be seen that the return loss pattern allows quadruple band operation at 824 MHz, 960 MHz, 1710 MHz and 1990 MHz. Again, the extra bandwidth in the upper band is a result of the pellet 5 being elevated above the groundplane 2.

Figure 7:
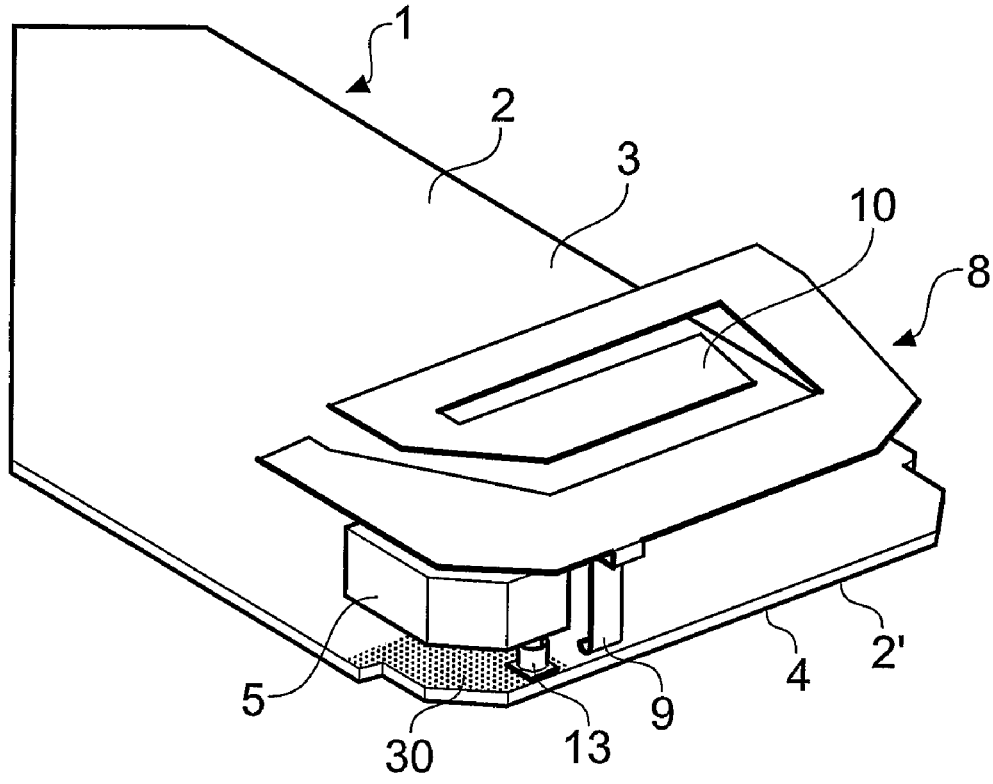
FIG. 7 shows a fifth embodiment of the present invention.

FIG. 7 shows another alternative embodiment of the invention with like parts being labelled as for FIG. 3. In this embodiment, an area 30 of the groundplane 2 directly underneath the pellet 5 is excised, such that there is no groundplane 2 directly underneath the pellet 5. The area 30 of groundplane 2 removed in this particular example is about 9 mm by 9 mm. By removing the groundplane 2, the bandwidth of the antenna 1 can be broadened even further so as to provide pentaband performance. The fact that this embodiment functions well even without a groundplane 2 under the pellet 5 indicates that the pellet 5 is not acting as a DRA in its own right, since a DRA requires a groundplane.

Figure 8:
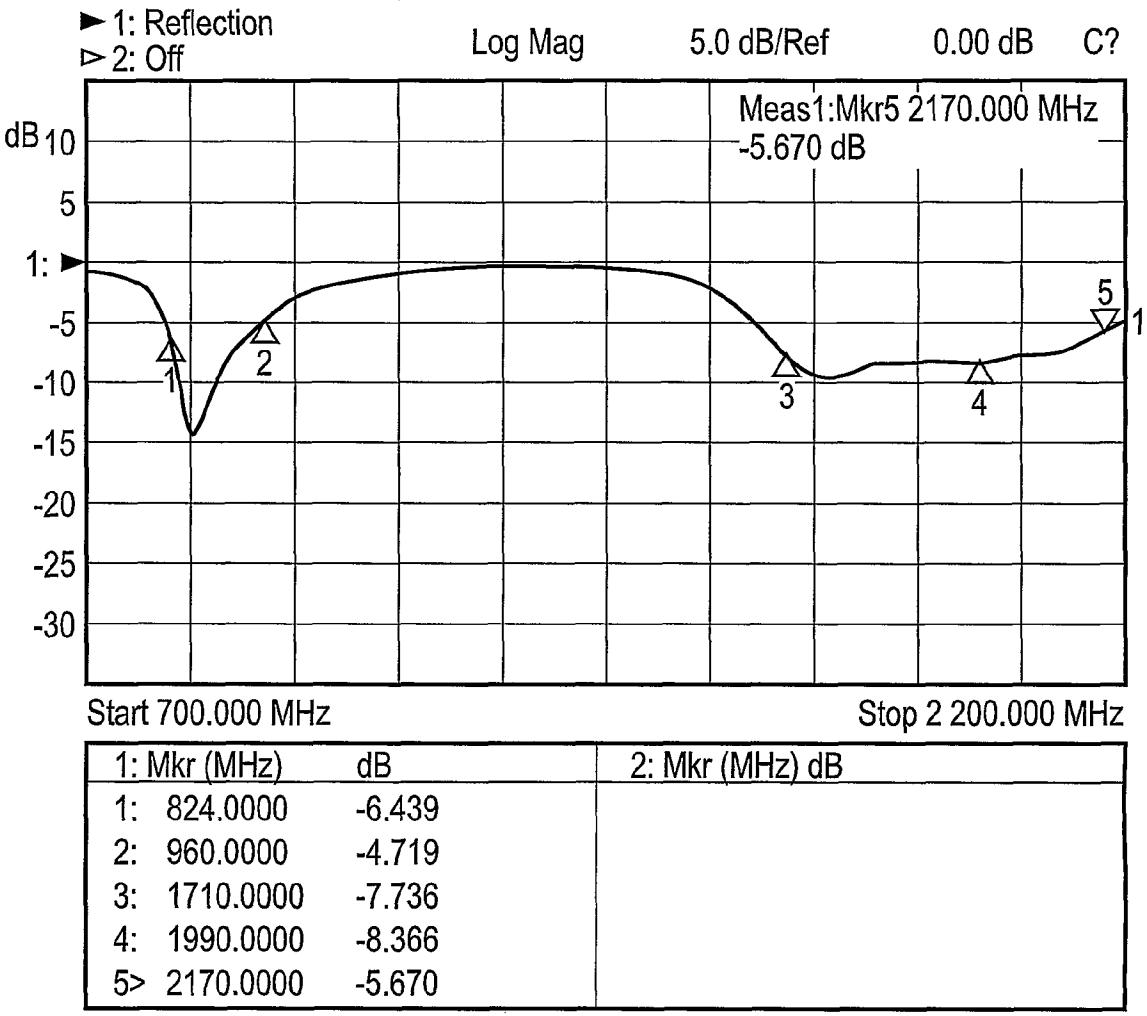
FIG. 8 shows a plot of return loss of the embodiment of FIG. 7.

FIG. 8 shows a return loss plot of the antenna of FIG. 7, showing pentaband operation at 824 MHz, 960 MHz, 1710 MHz, 1990 MHz and 2170 MHz.

Figure 14:
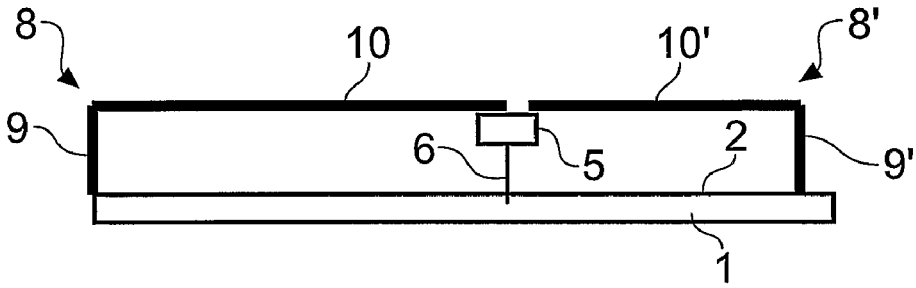
FIGS. 14 and 15 show a single dielectric pellet being used to feed or excite a pair of PILAs.
Figure 16:
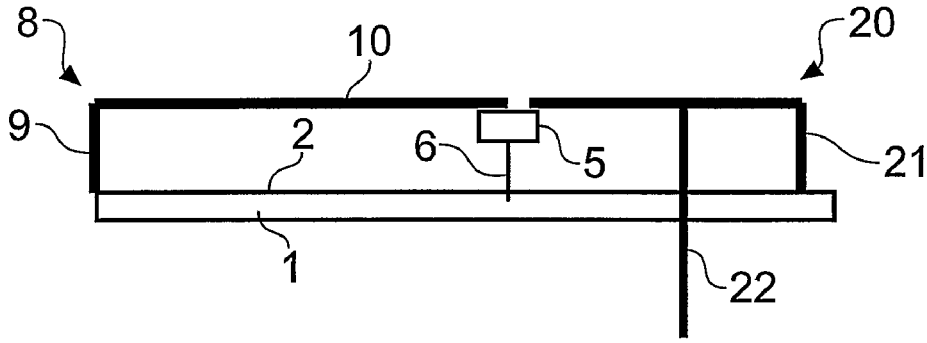
FIG. 16 shows a single dielectric pellet being used to feed a pair of radiating antenna components, one of which is a PILA and the other a PIFA.

FIGS. 9 to 12 show in schematic form various different arrangements of the feed 6 and the elevated dielectric pellet 5 in relation to a PILA 8 having a leg 9 and a radiating section 10, the components being mounted on a PCB substrate 1 with a groundplane 2. In FIGS. 14 and 16 small air gap is provided between facing surfaces of the dielectric pellet and the radiating section.

Figure 9:
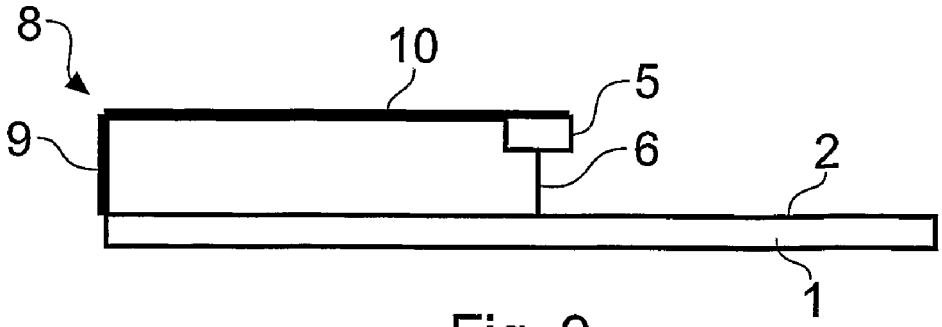
FIGS. 9 to 12 show alternative positions for a dielectric pellet in an embodiment of the present invention.

In FIG. 9, the pellet 5 is located far from the leg 9 (i.e. the shorting pin) of the PILA 8, and this provides a low capacitance end feed arrangement.

Figure 10:
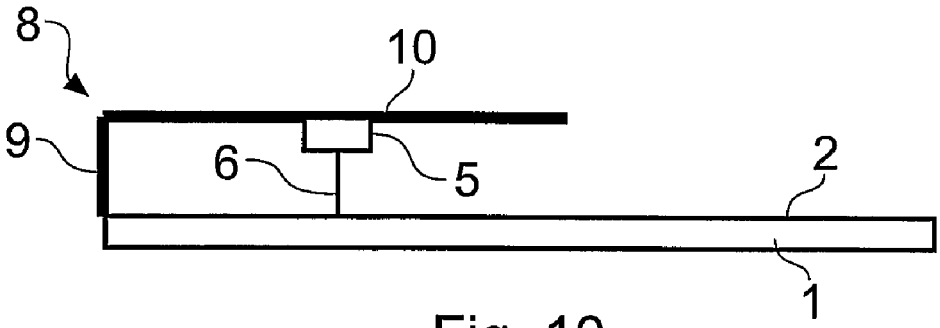

In FIG. 10, the pellet 5 is located between the leg 9 and the opposite end of the PILA 8, and this provides a medium capacitance centre feed arrangement.

Figure 11:
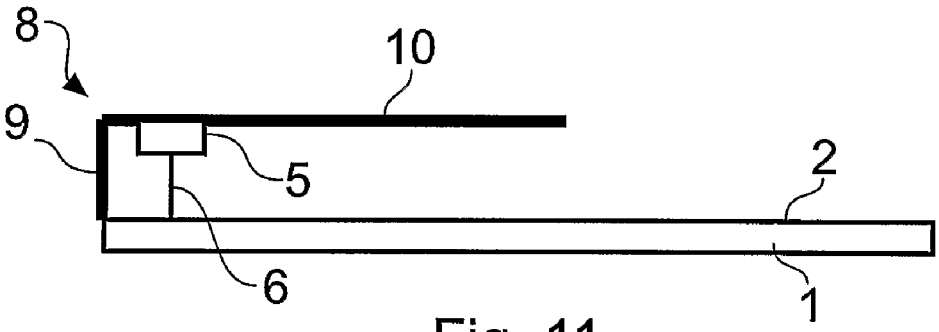

In FIG. 11, the pellet 5 is located close to the leg 9 of the PILA 8, and this provides a high capacitance feed arrangement.

Figure 12:
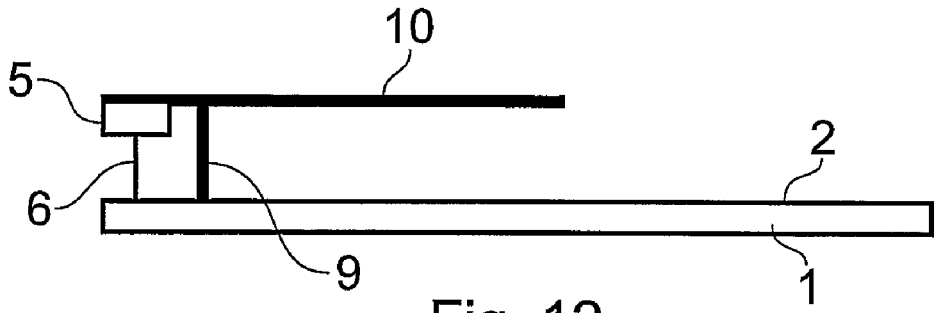

An alternative high capacitance feed arrangement is shown in FIG. 12, where the leg 9 of the PILA 8 is located a short distance in from an edge of the PCB 1 and the pellet 5 is located at the edge of the PCB 1.

Figure 13:
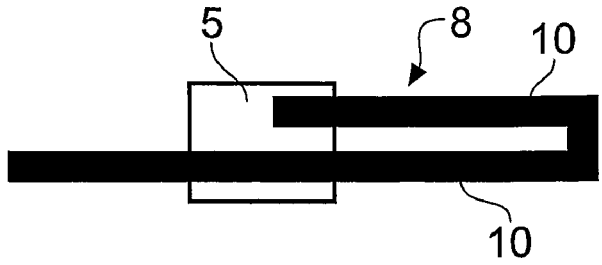
FIG. 13 shows an alternative configuration for a radiating antenna component in an embodiment of the present invention.

FIG. 13 shows, in schematic form and plan view, an arrangement in which the radiating section 10 of the PILA 8 doubles back on itself so as to pass twice over the elevated dielectric pellet 5. This arrangement allows the length of the radiating section 10 of the PILA 8 to be shortened, and thus for the antenna as a whole to be contained within a smaller space.

FIG. 14 shows, in schematic form and using the same reference numerals as FIGS. 9 to 12, an antenna in which a single elevated dielectric pellet 5 with a direct feed 6 serves to excite a pair of PILAs 8, 8'. In this embodiment, the PILAs 8, 8' are arranged so that the dielectric pellet 5 acts as a low capacitance end feed.

Figure 15:
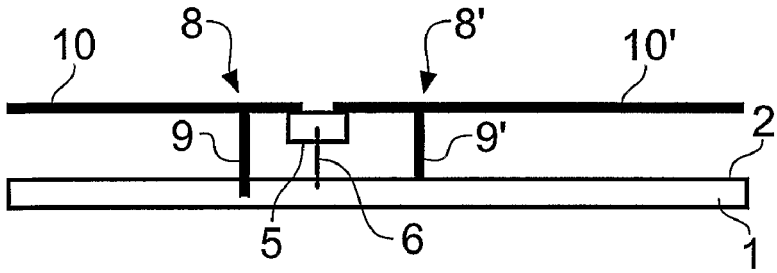

FIG. 15 shows an alternative arrangement to FIG. 14, with the PILAs 8, 8' here being arranged so that the dielectric pellet 5 acts as a high capacitance feed.

Feeding two or more PILAs 8, 8' in this way can create an extra resonance for GPS reception.

FIG. 16 shows an arrangement in which a single elevated dielectric pellet 5 excites a PILA 8 and also a PIFA 20 which has a leg or shorting pin 21 and its own independent feed 22.

Figure 17:
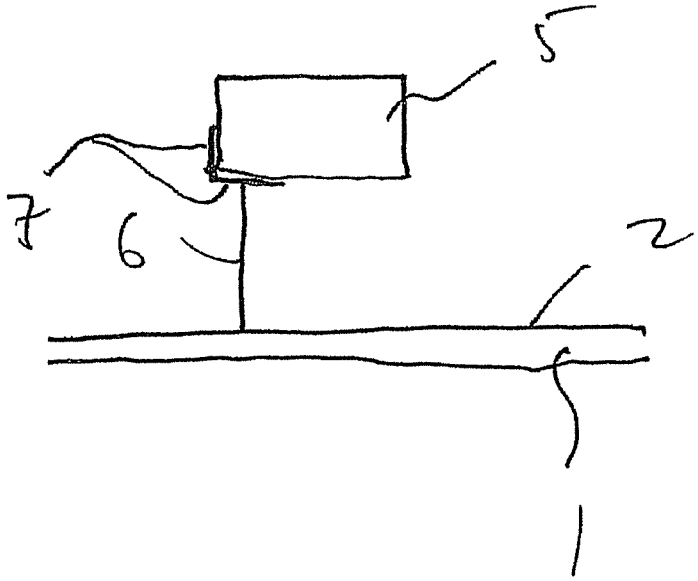
FIG. 17 shows the electrically conductive direct feed structure directly attached to more than one side or surface of the dielectric pellet.

FIG. 17 shows alternative embodiment in which two pellets 5 and 5' with electrically-conductive direct feeds 6 and 6' are provided.

Figure 18:
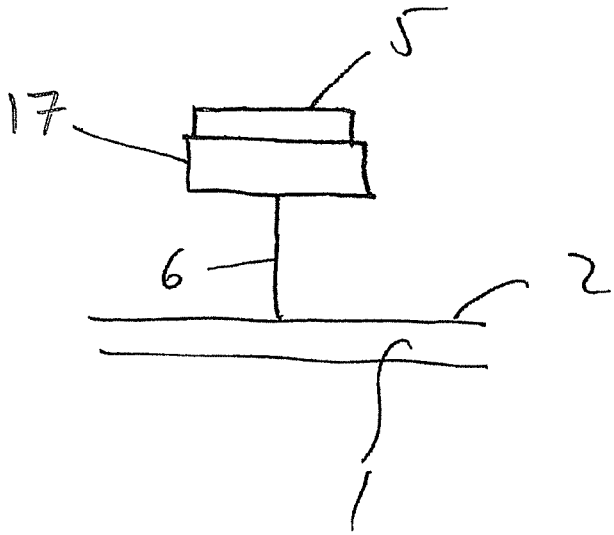
FIG. 18 shows the dielectric pellet contained in an electrically conductive cup or cage.

FIG. 18 shows a configuration of a PCB dielectric substrate 1 for an antenna structure in an embodiment of the invention. A groundplane 2' is sandwiched between upper surface 3 and lower surface 4 of PCB dielectric substrate 1.

The preferred features of the invention are applicable to all aspects of the invention and may be used in any possible combination.

Throughout the description and claims of this specification, the words "comprise" and "contain" and variations of the words, for example "comprising" and "comprises", mean "including but not limited to", and are not intended to (and do not) exclude other components, integers, moieties, additives or steps.

The invention claimed is:

1. An antenna structure comprising at least one feeding component formed as a dielectric ceramic pellet provided with an electrically conductive direct feed structure in direct electrical contact with the pellet, and further comprising at least one radiating component having a conductive element as a radiator, the at least one radiating component including a ground connection, wherein said pellet and said radiating component are adapted such that when the antenna structure is mounted on the upper surface of a dielectric substrate having an upper surface, a lower surface, and a groundplane, the pellet is elevated above the upper surface of the dielectric substrate so that the pellet does not directly contact the dielectric substrate or the groundplane, the radiating component is elevated above the upper surface of the dielectric substrate and has a surface that faces a surface of the pellet, and an air gap or other dielectric spacer material is provided between the pellet and the radiating component.

2. The antenna structure as claimed in claim 1, wherein the electrically-conductive direct feed structure extends from the upper surface of the dielectric substrate and directly contacts the dielectric pellet.

3. The antenna structure as claimed in claim 2, wherein the electrically-conductive direct feed structure physically supports the dielectric pellet.

4. The antenna structure as claimed in claim 2, wherein the dielectric pellet is elevated above the groundplane or the dielectric substrate by a low permittivity antenna support structure.

5. The antenna structure as claimed in claim 1, wherein the electrically-conductive direct feed structure is selected from a group consisting of: a conducting leg, a spring-loaded pin, a metal strip or a metal ribbon.

6. The antenna structure as claimed in claim 1, wherein the electrically-conductive direct feed structure is directly attached to at least one side or surface of the dielectric pellet.

7. The antenna structure as claimed in claim 6, wherein the electrically-conductive direct feed structure is directly attached to more than one side or surface of the dielectric pellet.

8. The antenna structure as claimed in claim 7, wherein the dielectric pellet is contained in an electrically-conductive cup or cage, and wherein the electrically-conductive direct feed structure is electrically connected to the cup or cage.

9. The antenna structure as claimed in claim 1, wherein at least one side or surface of the dielectric pellet is metallised, and wherein the electrically-conductive direct feed structure is soldered or otherwise electrically connected to the metallised side or said surface.

10. The antenna structure as claimed in claim 1, wherein the electrically-conductive direct feed structure is a spring-loaded pin extending upwardly from the upper surface of the dielectric substrate, wherein the dielectric pellet has a metallised underside that faces the upper surface of the dielectric substrate, and wherein a tip of the spring loaded pin electrically contacts the metallised underside.

11. The antenna structure as claimed in claim 1, wherein the radiating antenna component is an electrically-conductive antenna component.

12. The antenna structure as claimed in claim 11, wherein the radiating antenna component is selected from a group consisting of: patch antenna, slot antenna, monopole antenna, dipole antenna, planar inverted-L antenna and planar inverted-F antenna.

13. The antenna structure as claimed in claim 1, wherein the radiating antenna component is a dielectrically loaded antenna component.

14. The antenna structure as claimed in claim 13, wherein the radiating antenna component is configured as a planar inverted-L antenna with a radiating structure extending over a block of dielectric material such as a dielectric ceramic material.

15. The antenna structure as claimed in claim 1, wherein the radiating antenna component is provided with an independent feed.

16. The antenna structure as claimed in claim 15, wherein the radiating antenna component is a planar inverted-F antenna.

17. The antenna structure as claimed in claim 1, further comprising at least one additional radiating antenna component having a second surface that faces a surface of the dielectric pellet.

18. The antenna structure as claimed in claim 1, comprising a plurality of dielectric pellets.

19. The antenna structure as claimed in claim 1, wherein the groundplane is located on the lower surface of the dielectric substrate.

20. The antenna structure as claimed in claim 1, wherein the groundplane is located on the upper surface of the dielectric substrate.

21. The antenna structure as claimed in claim 1, wherein a first groundplane is located on the upper surface of the dielectric substrate and a second groundplane is located on the lower surface of the dielectric substrate.

22. The antenna structure as claimed in claim 1, wherein the groundplane is sandwiched between the upper and lower surfaces of the dielectric substrate.

23. The antenna structure as claimed in claim 1, wherein the groundplane extends across at least that part of the dielectric substrate that is located directly below the elevated dielectric pellet.

24. The antenna structure as claimed in claim 1, wherein the groundplane extends across substantially an entire area of the dielectric substrate.

25. The antenna structure as claimed in claim 1, wherein the groundplane is absent from an area of the dielectric substrate that is located below the dielectric pellet.

26. The antenna structure as claimed in claim 1, wherein a gap defined between the dielectric pellet and the upper surface of the dielectric substrate is filled with a solid dielectric filler with a dielectric constant less than the dielectric constant of the dielectric pellet.

27. The antenna structure as claimed in claim 26, wherein the solid dielectric filler has a dielectric constant not more than 10% of the dielectric constant of the dielectric pellet.

* * * * *